United States Patent [19]

Heidrich et al.

[11] Patent Number: 4,568,289

[45] Date of Patent: Feb. 4, 1986

[54] MARINE TRANSMISSION GEAR UNIT WITH DOUBLE DRIVE

[75] Inventors: Günther Heidrich, Burgberg; Karl Stölzle, Sonthofen/Allgäu, both of Fed. Rep. of Germany

[73] Assignee: BHS-Bayerische Berg-, Hutten-und Salzwerke, Munich, Fed. Rep. of Germany

[21] Appl. No.: 489,452

[22] Filed: Apr. 28, 1983

Related U.S. Application Data

[62] Division of Ser. No. 69,303, Aug. 24, 1979, Pat. No. 4,403,968.

[30] Foreign Application Priority Data

Aug. 24, 1978 [DE] Fed. Rep. of Germany 2837044

[51] Int. Cl.[4] ..... B63H 23/10

[52] U.S. Cl. ..... 440/3; 74/665 R; 74/665 A; 440/4; 440/75

[58] Field of Search ..... 114/269; 440/3, 4, 5, 440/75; 192/41 R; 74/665 R, 665 A, 665 B, 665 E, 665 N, 679, 350 R, 797, 745, 801, 802

[56] References Cited

U.S. PATENT DOCUMENTS

| | | | |
|---|---|---|---|
| 1,342,797 | 6/1920 | Conti | 74/665 B |
| 1,563,405 | 12/1925 | Schlumberger | 440/4 X |
| 1,616,415 | 2/1927 | Day | 440/4 X |
| 2,322,014 | 6/1943 | Grant | 440/75 |
| 3,056,314 | 10/1962 | Eichler et al. | 74/665 N X |
| 3,680,673 | 8/1972 | Webb | 192/41 R |
| 3,685,368 | 8/1972 | Thoma | 440/75 |
| 4,023,418 | 5/1977 | Zenker | 74/745 |
| 4,153,002 | 5/1979 | Sigg | 440/3 |
| 4,183,266 | 1/1980 | Osumi | 74/801 |

*Primary Examiner*—Sherman D. Basinger

*Attorney, Agent, or Firm*—Silverman, Cass & Singer, Ltd.

[57] ABSTRACT

A marine transmission gear unit with double drive where two driving engines are arranged offset from and on one side of and parallel to a propeller shaft axis and on opposite sides of gear train assembly including a common pinion gear and a greater wheel gear coupled to the propeller shaft. The two driving engines are arranged to drive the greater wheel gear by way of the pinion gear. An intermediate gear unit is coupled between the common pinion and at least one of the driving engines and a clutch device is disposed in the drive train adjacent the greater wheel. One or both engines are coupled to the common pinion through an intermediate gear unit. The engines can be codirectional in one direction or the opposite direction or can be contra-directed one relative to the other. The engines can be axially offset or coaxial. The clutch device may comprise an overriding clutch assembly. The intermediate gear unit may comprise either a spur gear and a planetary gear assembly, or a pair of planetary gear assemblies. Change of rotation within the gear unit can be effected easily.

16 Claims, 15 Drawing Figures

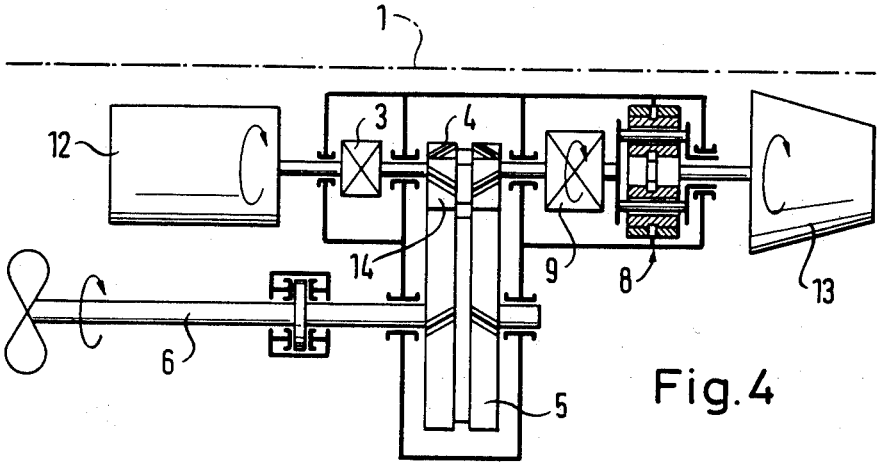
Fig. 4
Fig. 5
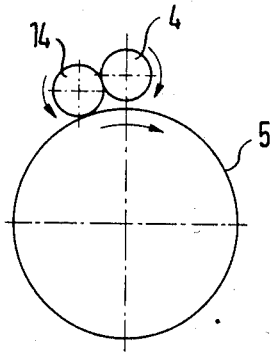
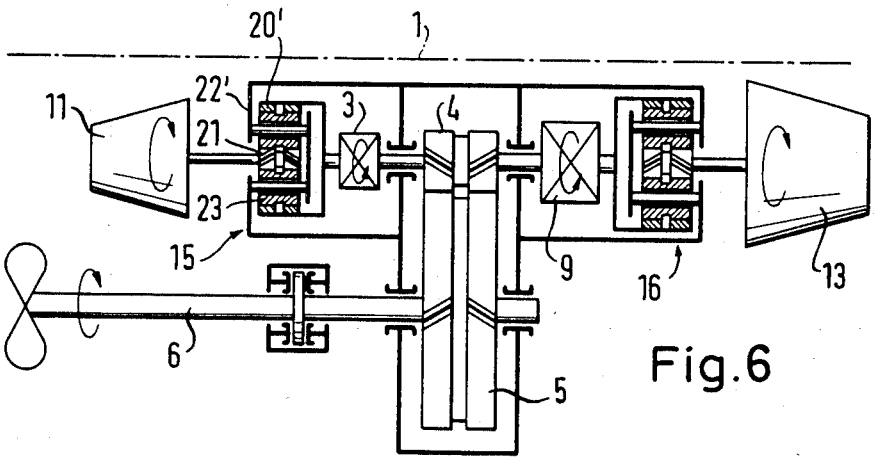
Fig. 6

MARINE TRANSMISSION GEAR UNIT WITH DOUBLE DRIVE

BACKGROUND OF THE INVENTION

This application is a division of application Ser. No. 069,303, filed Aug. 24, 1979, now U.S. Pat. No. 4,403,968, on which priority of this application is based.

The invention relates to a marine transmission gear unit with a double drive where two driving engines are arranged on one side of and parallel to the propeller shaft axis, and on both sides of a gearing assembly having a pinion and a greater wheel, the two driving engines driving the greater wheel by way of the common pinion. The propeller shaft is driven either by both driving engines simultaneously, or by one driving engine at a time via the gearing assembly.

Wellknown marine transmission gear units of the aforementioned type employ spur gears having a multistage design for the reduction of the number of revolutions. The number of reduction stages is dependent upon the type of driving engine used. High speed or gas turbines require a greater reduction ratio and hence more stages than the slower-rotating diesel engines.

Two-fold capacity branchings are provided in order to reduce the large space requirement by such gearing assemblies so that the branching wheels or gears are connected with the pinion gears of the neighboring stage by way of torsion bars. This expedient results in a considerable cost increase.

Moreover, where all gear wheels co-rotate independent of the stage of travel and regardless of which engine drives the gear assembly, the noise level is too great in addition to reduction in the effectiveness and efficiency of the gear assembly. Accordingly, it has not been possible to reduce the number of noise sources and loss sources for certain travel stages such as for the so-called "marching" or "creeping travel" stage.

It would be advantageous to provide smaller and lighter weight gearing assemblies; to reduce the spatial area required for accommodating the gear assembly; to simplify production, inspection and servicing of the gear assemblies; to provide for improved operation of the gear assemblies; to eliminate the need to provide torsion bars for load balancing purposes and to improve the operating efficiency and capacity of the transmission structures.

It would be desirable if the same driving engine could be used on portside and starboard side locations with a reversal of direction easily provided without substantial structural expenditure.

SUMMARY OF THE INVENTION

A marine transmission gear unit for use with a pair of driving engines, a propeller mounted on a shaft and the driving engines arranged on one side and parallel to the propeller axis, and a gear assembly including a common pinion gear and a greater gear coupled to both driving engines by way of the common pinion gear, at least one secondary gear assembly coupled between the respective driving engine and the greater gear and a switching assembly arranged between the secondary gear and the greater gear.

The secondary gear may be a planetary gear arrangement or a spur gear arrangement.

Preferably the switching assembly is a synchronous self-switching overriding clutch.

BRIEF DESCRIPTION OF THE DRAWING

FIG. 4 is a diagrammatic top view of the starboard driving unit having one preceding step and the driving engines are coaxial;

FIG. 5 is a diagrammatic lateral view of the wheels of the principal step according to FIG. 4;

FIG. 6 is a diagrammatic top view of the starboard driving unit having two preceding steps and the driving engines being coaxial;

DESCRIPTION OF PREFERRED EMBODIMENTS

Figure 1:
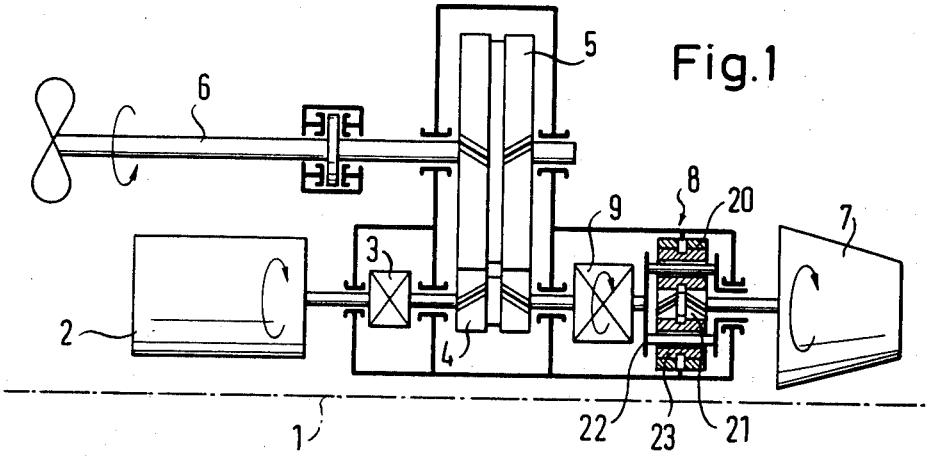
FIG. 1 is a diagrammatic top view of the portside driving unit illustrating presence of a preceding step and coaxial driving engines.

The invention contemplates the interposition of an improved secondary gear arrangement coupled between an oppositely located pair of drive engines and a greater gear by way of a common pinion gear, the secondary gear arrangement including either one or the other of both of planetary gear assembly and a spur gear assembly coupled between the driving engine and the common pinion gear.

In respect of the planetary gear assembly, the following advantages are believed to accrue when interposed as compared to well-known gear assemblies.

Planetary gear assemblies are provided with more than twofold capacity branching. Thereby the gear assemblies have smaller and ligher gears. Moreover, the smaller gears produce lower speeds at at their teeth and thereby reduce dynamic tooth forces and noise.

Planetary gear assemblies are coupled coaxially to driving and driven shafts so that the spaced required is again reduced. Moreover, the gear housings become more simple.

Planetary gear assemblies also permit greater reduction ratios so that the number of rotations of the high speed driving engine can be reduced to the extent that the spur gear assemblies can be made single stage with a low reduction ratio. Accordingly, one is able to provide spur gear assemblies without problems wiith respect to load and form, and including relatively narrow gear wheels. Further, the greater wheel of the gear assembly can be made smaller in diameter with much simplification in production and gain of spatial economy. It should be further noted that the use of planetary gearing permits a reversal of the direction of rotation without additional constructional expenses.

All combination elements of the gear assembly are in a common plane if the driving engines are not displaced with respect to height for special reasons whereby to achieve an easily inspected very simple construction. Only one horizontal separating line of the housing is required so as to facilitate service and one will note that there are relatively small construction parts so that change, where necessary, can be effected without the necessity of removing neighboring elements.

Well-known marine drives include the use of overriding clutches as switching aggregates, said clutches being arranged between the driving engines and the spur gears. However, where turbines are used as driving engines, this arrangement results in the drag moment of the overriding clutch (moment in the disengaged state) and by the very slight frictional resistances of the turbine rotor, co-rotation of the motor by the driving engine which drives the gear unit occurs after the turbine has been turned off. In order to achieve the desired stoppage of the turbine rotor, it is therefore necessary to provide a brake which acts on the turbine rotor. However, thereby the construction expenditures increase again.

The well-known gear units have further deficiencies also regarding service and inspection. In view of the arrangement of the individual gears of the spur gear assembly (stages) in several horizontal planes, there result complicated gearing housings having joints partly inclined by up to 45°. The servicing and inspection work to be carried out is therefore difficult and expensive.

The invention provides a marine transmission gear unit of the type mentioned earlier which is constructed simply, has a low noise level, makes it possible that the driving engines are arranged with axes displaced coaxially or parallel, and that furthermore the possibility exists that a vertical displacement of the driving engines relative to the propeller shaft can be carried out without additional intermediate gears. On the other hand, by a special design of the gearing construction, the direction of rotation within the gear unit also is supposed to be changeable.

This problem is solved by the fact that the gear assembly according to the invention is a combination of the greater wheel and the common pinion as the main step, of at least one other gearing as a preceding step and of two switching units arranged directly before the principal step. As a gear assembly for the preceding step, there is provided a spur gearing assembly or, in a further embodiment of the invention, a planetary gearing assembly.

Switching units in the form of overriding clutch means are provided directly before the spur gear assemblies so that no additional brake is required for switching off the turbine rotor of turbine drives having a preceding step constituted by the gear assembly. Co-rotation of the turbine rotor by the other driving drive engine cannot occur since the relatively slight drag moment of the overriding clutch means is not in a position to overcome the far greater frictional resistances of the preceding step comprised by the spur gear or planetary gear or both, as the case may be.

Extremely high demands i.e., restrictions, are made on marine transmission gear units in respect of sound transmitted by air, and sound conducted through solids. Such demands refer primarily to a definite travel stage. Accordingly, if the driving engines comprise a diesel motor and gas turbine engine, only the diesel engine drives the gear unit. Normally the engaging of the teeth and the bearings of the gears have a noise causing effect. Thus for the travel stage, which is desired to be especially low in noise (quiet), the number of noise sources may be reduced to a minimum. It will be seen that because the switching units are arranged directly before the spur gear assemblies, the aforementioned demands are met. In particular, a switch-off occurs and thereby a stoppage of the entire proceeding step by the overriding clutch means where same is employed as a switching unit.

Further, the gearing as defined in the invention makes possible a twofold capacity branching without the necessity of having to provide torsion bars as a load balancing device. Thus the invention corresponds also to the tendency to greater and greater capacities in the working engines with gearings as space saving as possible.

Also, the portside and the starboard side can have the same driving engine, and also, the same direction of rotation. A reversal of the direction of rotation is possible without great structural expenditures. Advantage results also where two shaft drives are employed with contrarotating propellers.

In the ensuing description hereinafter, there is illustrated and described a two-shaft drive with only one of the two driving units being illustrated in the drawings each time. The line "1" indicates the center axis of the ship carrying the drive, etc.

According to FIG. 1, a slow running driving engine 2, preferably a diesel motor, is connected with a pinion 4 of a spur gearing by way of an overriding clutch 3. The spur gearing represents the main step. The teeth of the pinion 4 engage with a greater wheel 5 which is fastened on a propeller shaft 6. Pinion 4 and greater wheel 5 constitute a slow speed main step. In the forecastle direction there is a high speed driving engine 7, preferably a gas turbine, which is coupled with the high speed shaft of a planetary gear assembly 8 which is a high speed secondary gear means. The planetary gear assembly 8 represents the preceding step. The slow-running shaft of the planetary gearing 8 is connected with the common pinion 4 by way of an overriding clutch 9.

The illustrated gear unit according to FIG. 1 permits the following travel stages:

STAGE 1.

The driving engine 2 drives alone. By the overriding function of the clutch 9 the slow-running shaft of the planetary gear assembly 8 is here disengaged. Accordingly, no running noise originates in the planetary gear assembly 8. Moreover, the frictional resistances in this gearing prevent the co-rotation of the driving engine 7 in spite of the drag moment of the overriding clutch 9. Thus this travel stage is frequently called marching or creeping travel and is especially low in noise since only a single sound source, namely the engaging of the teeth between gears 4 and 5, exists.

STAGE 2.

The drive engine 7 drives alone. The fast-running driving engine 7 has usually a far greater torque than the slow-running driving engine 2. Thereby it is possible to increase the number of revolutions of the propeller and thereby the speed of the ship. This travel stage is identified as the so-called flight travel in connection with marine transmission gear units. Considering the size of the gearing, it is very advantageous that a planetary gearing is used for the driving engine having the greatest capacity since here, for instance, a fivefold or sixfold capacity branching is usual.

STAGE 3.

Both driving engines 2 and 7 drive at the same time.

Figure 2:
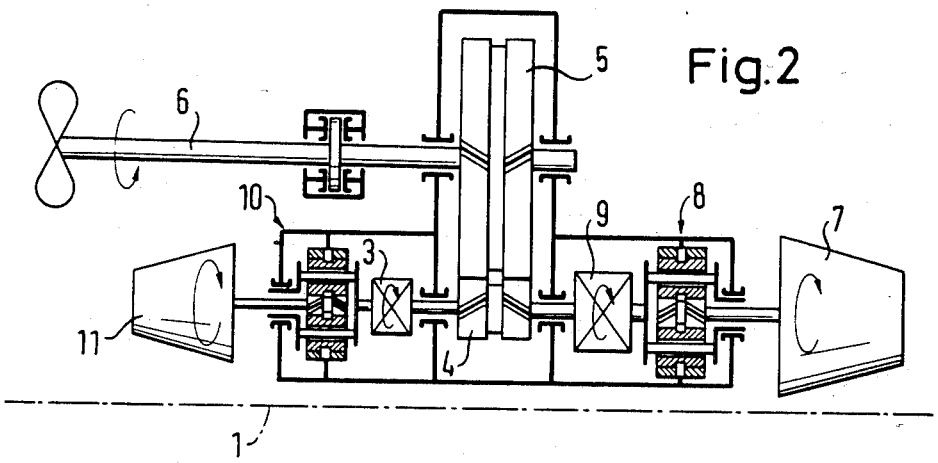
FIG. 2 is a diagrammatic top view of the portside driving unit but having two preceding steps and coaxial driving engines.

According to FIG. 2, an additional preceding step 10 is provided—with a high speed driving engine 11 being provided in this case in place of the slow-running driving engine 2 provided in the embodiment illustrated in FIG. 1. If only one of the two driving engines 7 or 11 drives the gear unit, each time the preceding step of the other driving engine is disengaged by the respective overriding clutch 3 or 9. The driving engine 11 can be a gas turbine or also a high speed diesel engine.

Figure 3:
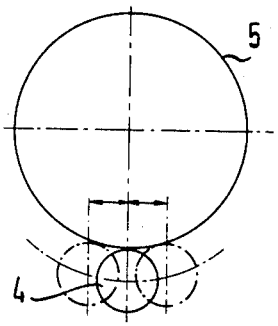
FIG. 3 is a diagrammatic lateral view of the wheels of the principal step according to FIGS. 1 and 2.

In FIG. 3, the pinion gear is displaced to enable raising or lowering of the driving engines relative to the shaft of the greater gear 5, and thereby, also relative to the propeller shaft 6.

Figure 7:
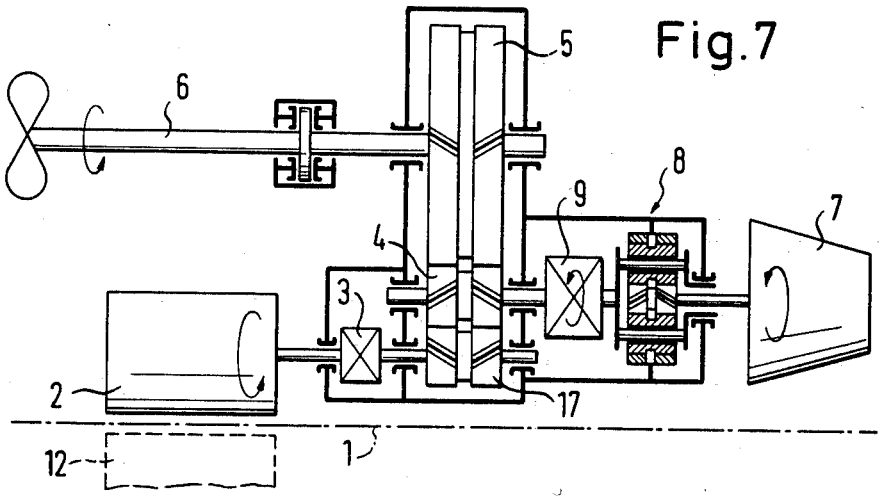
FIG. 7 is a diagrammatic top view of the portside driving unit having one preceding step and displaced driving engines.

A starboard driving unit is illustrated in FIG. 4 and has driving engines 12 and 13 having the same direction of rotation as the portside driving engines 2 or 7 according to FIG. 7. The necessary reversal of the direction of rotation is achieved by the addition of an intermediate gear 14.

FIG. 5 represents the arrangement of said intermediate gear 14 and the gears 4 and 5. The teeth of gears 4 and 5 are made to disengage. In order to make possible uniform shaft distances in the portside and starboard spur gearings, the size of gears 4 and 5 is reduced by the required clearance.

In FIG. 1, the outer central wheel 20 on all previously mentioned planetary gear assemblies is placed stationary in the housing, whereas the inner central wheel 21 is connected with the high-speed driving engine 7. The planetary gear assembly carrier 22, which carries the planetary gears 23, is connected with the pinion 4 of the principle step by way of the overriding clutch 9.

In FIG. 6, a somewhat different construction is selected. The inner central wheel 21 is connected with the high-speed driving engine 11. The outer central wheel 20′ is connected with the pinion 4 by way of the overriding clutch 3, whereas the planetary gear carrier 22′ is arranged stationary in the housing. Thereby it is possible to achieve reversal of the direction of rotation for the gear unit with two preceding steps, without the addition of an intermediate gear merely by changing the planetary gearing with a rotating planetary gear carrier, to stationary gearing 15 and 16 with a stationary crossbar. The driving and the driven shaft of the stationary gearings 15 and 16 now have opposite directions of rotation. Accordingly, neither construction costs nor the noise sources and loss sources increase.

FIG. 7 illustrates the portside gear unit according to FIG. 1 but with the driving engines 2 and 7 displaced offset parallel relative to each other. Whereas in the previously mentioned embodiments, the driving engines have always the same direction of rotation, there exists, according to FIG. 7, a reversed direction of rotation of the driving engine 2 relative to the driving engine 7. The arrangement is of advantage if the portside and starboard diesel motors 2 and 12 (FIG. 4) are set up in a common capsule. Therefore it is of advantage if both motors 2 and 12 stand closely together.

The gear costs for providing the displaced driving engines increase only insignificantly by addition of the pinion 17 which is of equal drive character as pinion 4. By equal drive character, it is meant that the several pinions are of substantially the same gear configuration but may utilize differing mounting hub forms.

Figure 8:
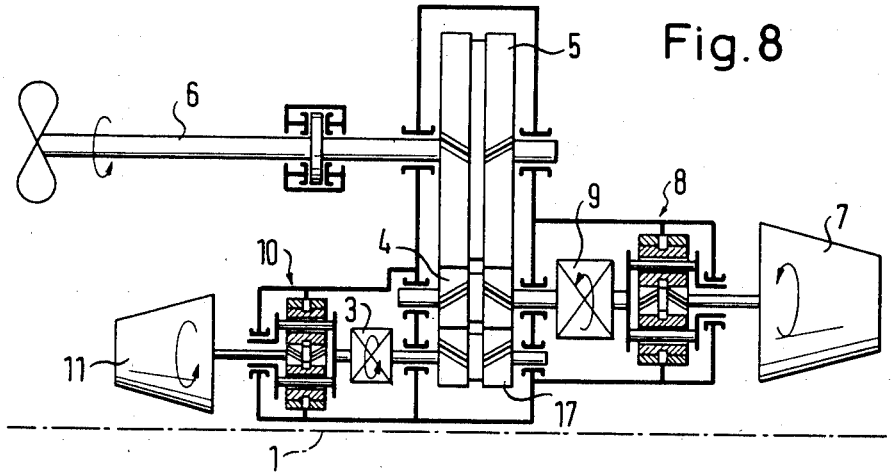
FIG. 8 is a diagrammatic top view of the portside driving unit having two preceding steps and displaced driving engines.

FIG. 8 illustrates an arrangement having displaced high speed driving engines 7 and 11 when these run fast and need two preceding steps. Again two planetary gearings 8 and 10, as well as two overriding clutches 3 and 9, are provided.

Figure 9:
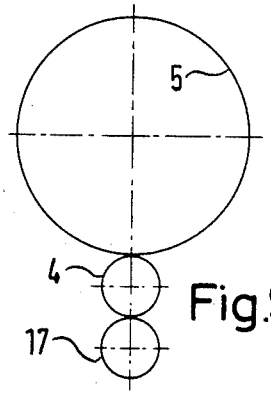
FIGS. 9, 10 and 11 are each diagrammatic lateral views of the wheels of the principal step in the structures illustrated in FIGS. 6, 7 and 8 respectively.

FIG. 9 illustrates the disposition of the gears of the principal step, the wheels 4, 5 and 17 being in one plane.

Figure 10:
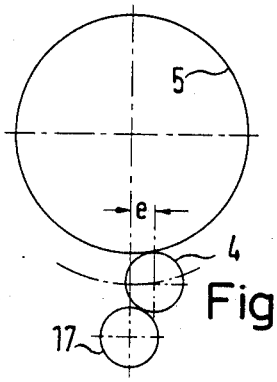

FIG. 10 illustrates, displaced with respect to height, an arrangement of the wheels of the main step with wheels 5 and 17 being in one plane, whereas wheel 4 is displaced by the value e.

Figure 11:
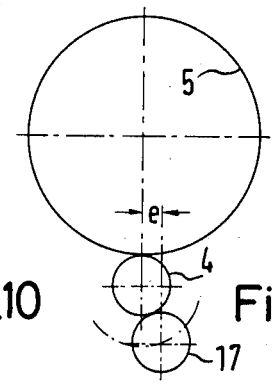

FIG. 11 illustrates the wheels of the main step with wheels 4 and 5 being in one plane, and wheel 17 being displaced by the value e.

Even in connecting with the provision of displaced driving engines, it is possible according to FIG. 4, 5 and 6, that the driving engines have the same direction of rotation on the portside and the starboard side.

Figure 12:
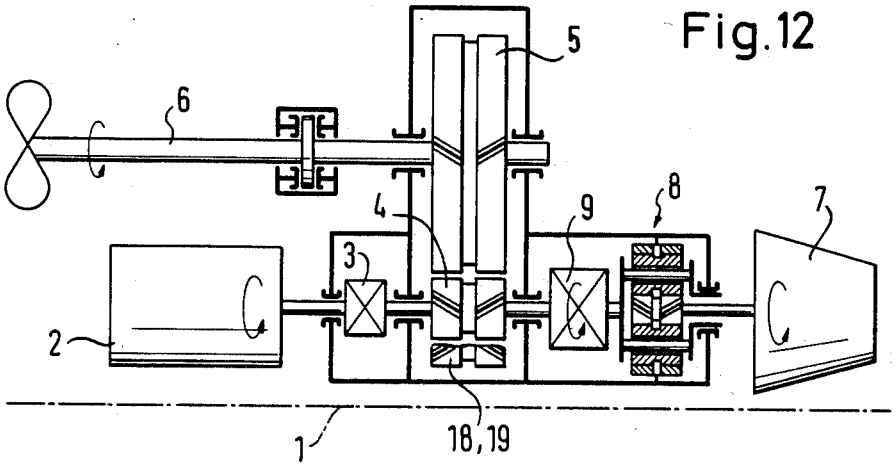
FIG. 12 is a diagrammatic top view of the portside driving unit with one preceding step, coaxial driving engines and capacity branching in the principal step.

FIG. 12 shows how on the same spur gearing a twofold capacity branching is possible without expensive torsion bars being required to achieve load balancing. The common pinion 4 meshes with two equally large branching gears 18 and 19 which are arranged at diametrically opposite locations relative to the pinion 4. These branching gears 18 and 19 transmit the capacity to the greater gear 5.

Figure 13:
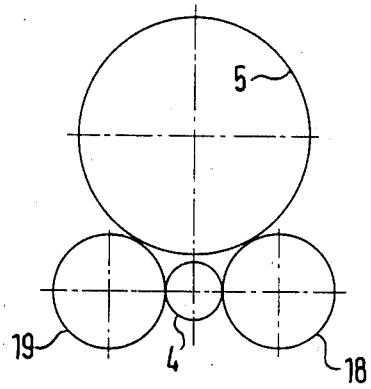
FIG. 13 is a diagrammatic lateral view of the wheels of the principle step according to FIG. 12 with coaxial driving engines.
Figure 14:
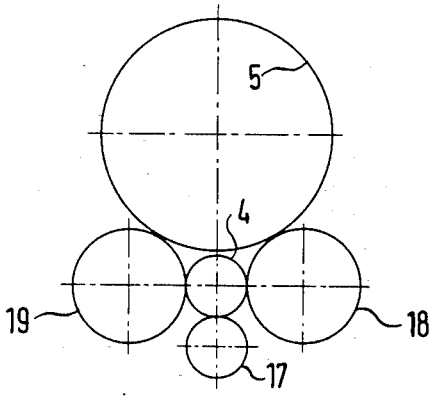
FIG. 14 is a diagrammatic lateral view of the wheels of the principle step according to FIG. 12 where the driving engines are displaced, one relative the other.

The capacity branching in connection with coaxial driving engines is illustrated in FIG. 13 while the capacity branching in connection with driving engines displaced parallel is illustrated in FIG. 14.

In place of the planetary gearings as a preceding step, it is also possible to employ spur gearings (not shown in detail).

Figure 15:
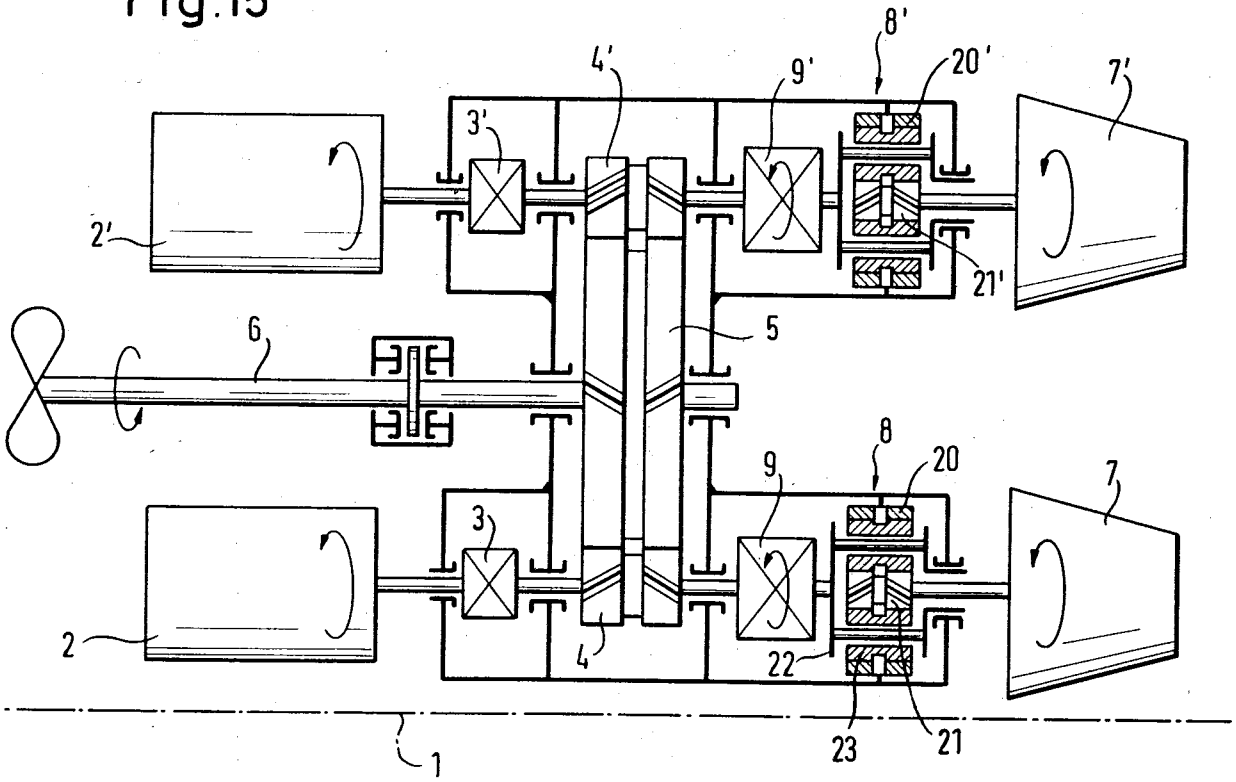
FIG. 15 is a diagrammatic top plan view illustrating another embodiment of the invention.

According to FIG. 15, the spur gearing can consist of the greater wheel 5 and two pinions 4′ with each pinion being driven by two driving engines 2′ and 7′. Again two overriding clutches 3′ and 9′ are provided—with another gearing 8′, for instance, a planetary gearing with an outer and inner central wheel 20′ and 21′ being possibly arranged between the overriding clutch 9′ and the driving engine 7 made as a gas turbine.

Further, the invention contemplates an arrangement analogous to FIG. 2, in the embodiment according to FIG. 15. A gear 10, as a preceding step, is disposed between the driving engine 2′ and the overriding clutch 3′. This gearing can be, for instance, a planetary gearing. The embodiment illustrated in FIG. 15 is appropriate if, on the propeller shaft, there is required a capacity which transmits the capacity of the existing gas turbine 7 twofold or manyfold. Moreover, the distribution onto several drives 2, 7, 2′, 7′ can be necessary if special safety requirements demand a doubling of the drives.

We claim:

1. In a multiple step marine transmission gear unit with double drive for use with a pair of driving engines arranged on one side of and parallel to the axis of a propeller shaft driven thereby and on both sides of a slow speed main step of a transmission gearing assembly including pinion drive means and a greater gear, the pair of engines arranged to drive the greater gear by way of the pinion drive means as the slow speed main step, the invention comprising a singular high speed secondary gear means operably coupled between one of the driving engines and the pinion drive means and at least one switching aggregate arranged directly coupled to the main step between the secondary gear means and the main step, said pair of driving engines being displaced off set with their axes in parallel one relative to the other and including first and second pinion gear means each of equal drive character operably coupled directly to each other and selectively coupled one to each of said driving engines to drive the greater gear and another switching aggregate between said other of said driving engines and said pinion means.

2. A marine transmission gear unit as claimed in claim 1 wherein said secondary gear means comprise a spur gear.

3. A marine transmission gear unit as claimed in claim 1 wherein said secondary gear means comprise a planetary gear assembly.

4. A marine transmission gear unit as claimed in claim 3, wherein a high speed driving engine is connected with the planetary gear assembly.

5. A marine transmission gear unit as claimed in claim 3 wherein a high speed driving engine is connected with the planetary gear assembly, said planetary gear assembly comprising an outer central wheel connected with the pinion drive means by way of the switching aggregrate, an inner wheel connected with the respective driving engine and a stationary planetary gear carrier.

6. A marine transmission gear unit as claimed in claim 1 wherein the second pinion gear means includes a pinion gear displaced axially parallel to the center plane of the pinion drive means and the greater gear.

7. A marine transmission gear unit as claimed in claim 6 wherein the secondary gear means is arranged operatively to couple a slow-speed driving engine to the pinion drive means.

8. A marine transmission gear unit as claimed in claim 1 and wherein a pair of branching gear wheels are operatively coupled between the pinion drive means and the greater gear.

9. A multiple step marine transmission gear unit as claimed in claim 8 wherein said second pinion gear means is displaced offset relative to the center plane of the greater gear.

10. A marine transmission gear unit as claimed in claim 1 and a pair of branching gear wheels intermediate the pinion drive means and the greater gear, the pinion drive means being operatively coupled to the greater gear through the said branching gear wheels.

11. A marine transmission gear unit as claimed in claim 1 wherein the pair of driving engines are both high-speed engines and said secondary gear means comprise a planetary gear assembly coupled between each driving engine and the pinion drive means.

12. A marine transmission gear unit as claimed in claim 11 wherein said planetary gear assembly comprises a stationary outer central wheel, an inner central wheel and a planetary wheel carrier, said inner central wheel being operably coupled respectively to the driving engine and the planetary wheel carrier with the pinion drive means by way of the switching aggregate.

13. A marine transmission gear unit as claimed in claim 11 wherein said planetary gear assembly comprises an outer central wheel connected with the pinion drive means by way of the switching aggregate, an inner central wheel connected with the, respective driving engine and a stationary planetary gear carrier.

14. A multiple-step marine transmission gear unit as claimed in claim 1 wherein the driving engines are both high-speed engines and said secondary gear means comprise a planetary gear assembly coupled between each driving engine and the pinion drive means and said switching aggregate coupled between said planetary gear assembly and the slow speed main step of the transmission.

15. A marine transmission gear unit as claimed in claim 1 wherein said secondary gear means comprise a planetary gear assembly comprising a stationary outer central wheel, an inner central wheel coupled with the respective driving engine and a planetary wheel carrier with the pinion drive means by way of said switching aggregate.

16. A marine transmission gear unit as claimed in claim 1 wherein at least one switching aggregate comprises a synchronizing self-switching overriding clutch.

* * * * *